US011499101B2

(12) United States Patent
Peters et al.

(10) Patent No.: US 11,499,101 B2
(45) Date of Patent: Nov. 15, 2022

(54) MERCURY CAPTURE FROM HYDROCARBON FLUIDS USING DEEP EUTECTIC SOLVENTS

(71) Applicant: KHALIFA UNIVERSITY OF SCIENCE AND TECHNOLOGY, Abu Dhabi (AE)

(72) Inventors: Cornelis J. Peters, Abu Dhabi (AE); Maaike Kroon, Abu Dhabi (AE); Samah Warrag, Abu Dhabi (AE); Donald Reinalda, Abu Dhabi (AE)

(73) Assignee: KHALIFA UNIVERSITY OF SCIENCE AND TECHNOLOGY, Abu Dhabi (AE)

( * ) Notice: Subject to any disclaimer, the term of this patent is extended or adjusted under 35 U.S.C. 154(b) by 0 days.

(21) Appl. No.: 16/767,165

(22) PCT Filed: Nov. 28, 2017

(86) PCT No.: PCT/IB2017/057433
§ 371 (c)(1),
(2) Date: May 27, 2020

(87) PCT Pub. No.: WO2019/106406
PCT Pub. Date: Jun. 6, 2019

(65) Prior Publication Data

US 2020/0385640 A1 Dec. 10, 2020

(51) Int. Cl.

| | |
|---|---|
| ***C10G 21/06*** | (2006.01) |
| ***C10G 21/20*** | (2006.01) |
| ***C10G 21/24*** | (2006.01) |
| ***C10G 21/27*** | (2006.01) |
| ***C10G 21/28*** | (2006.01) |
| ***C10G 29/20*** | (2006.01) |

(52) U.S. Cl.
CPC ..... *C10G 21/06* (2013.01); *C10G 2300/205* (2013.01)

(58) Field of Classification Search
CPC ..... C10G 21/06; C10G 21/20; C10G 21/24; C10G 21/27; C10G 21/28; C10G 29/20; C10G 2300/205
See application file for complete search history.

(56) References Cited

U.S. PATENT DOCUMENTS

| | | | | |
|---|---|---|---|---|
| 2010/0270211 | A1* | 10/2010 | Wolny | C10G 21/24 208/243 |
| 2012/0190905 | A1 | 7/2012 | Gorke et al. | |
| 2014/0001100 | A1* | 1/2014 | Abai | C10G 21/20 208/253 |

FOREIGN PATENT DOCUMENTS

| | | | |
|---|---|---|---|
| CN | 107384469 | A | 11/2017 |
| KR | 101741899 | B1 | 6/2017 |
| WO | 2010/116165 | A2 | 10/2010 |
| WO | 2012/046057 | A2 | 4/2012 |
| WO | 2016/139280 | A1 | 9/2016 |

OTHER PUBLICATIONS

A. P. Abbott et al., Deep Eutectic Solvents Formed Between Choline Compounds and Carboxylic Acids: Versatile Alternatives to Ionic Liquids, 126 J. Am. Chem. Soc. 9142-9147 (2004).*

M. K. AlOmar, Novel Deep Eutectic Solvent-Functionalized Carbon Nanotubes Adsorbent for Mercury Removal From Water, 497 J. Colloid Interface Sci. 413-421 (2017).*

International Search Report and Written Opinion for corresponding International Application No. PCT/IB2017/057433 dated Jul. 18, 2018.

* cited by examiner

*Primary Examiner* — Randy Boyer
(74) *Attorney, Agent, or Firm* — Billion & Armitage

(57) ABSTRACT

The present invention relates to a method for the extraction of mercury from a mercury-containing hydrocarbon feed, and to the use of a hydrophilic deep eutectic solvent for the extraction of a mercury source from a hydrocarbon feed.

15 Claims, 1 Drawing Sheet

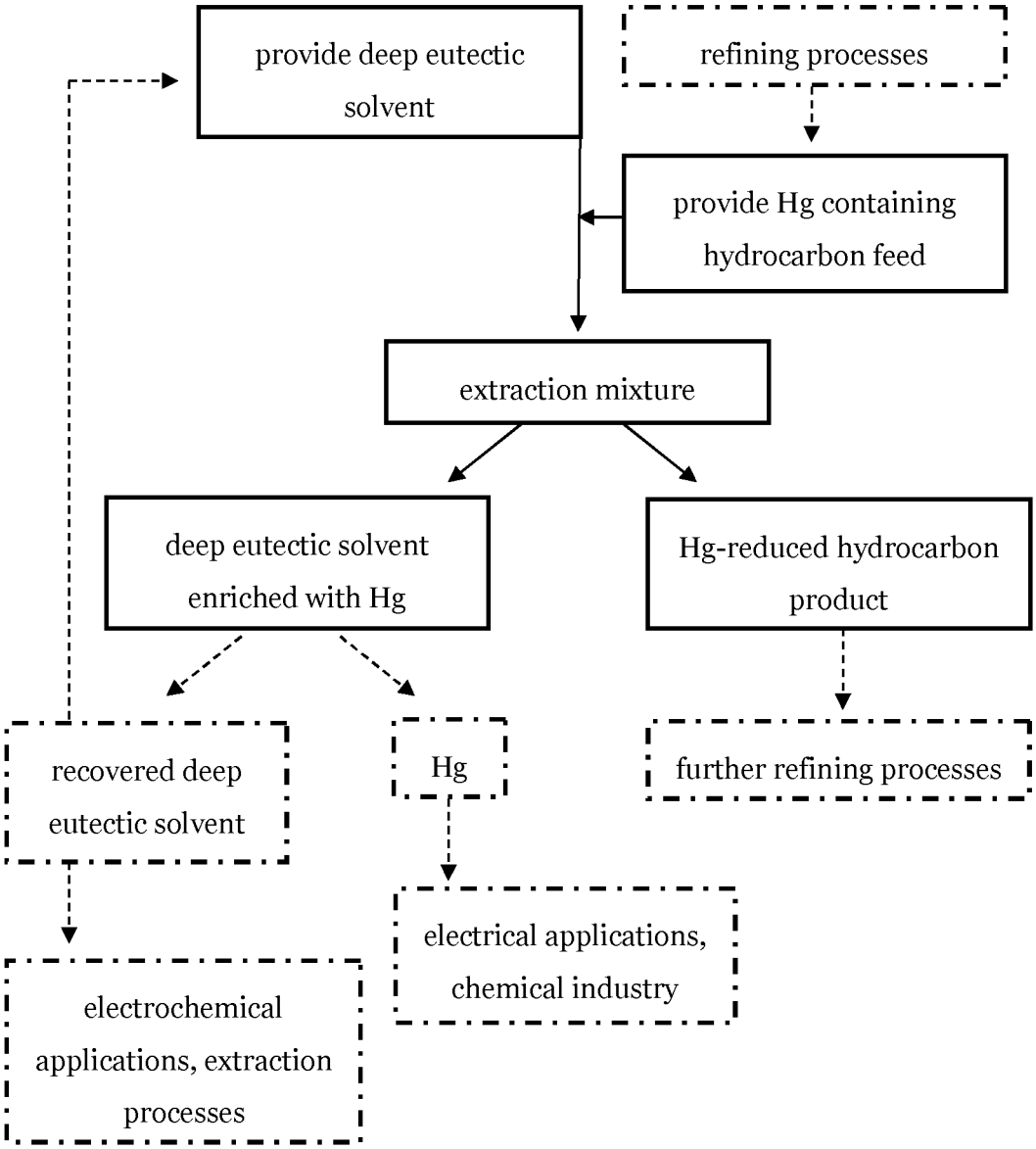
provide deep eutectic solvent
refining processes
provide Hg containing hydrocarbon feed
extraction mixture
deep eutectic solvent enriched with Hg
Hg-reduced hydrocarbon product
recovered deep eutectic solvent
Hg
further refining processes
electrical applications, chemical industry
electrochemical applications, extraction processes

MERCURY CAPTURE FROM HYDROCARBON FLUIDS USING DEEP EUTECTIC SOLVENTS

1. FIELD OF THE INVENTION

The present invention relates to the petrochemical field of hydrocarbon processing. The invention is directed to the extraction of mercury compounds from hydrocarbon feeds by means of deep eutectic solvents as extracting solvents.

2. PRIOR ART

During the last decades, research efforts have been devoted to investigating novel, energy-efficient, economically feasible and environmentally friendly processes for the production of fuels and value-added hydrocarbons. Natural gas sweetening and carbon dioxide capture technologies garnered a vast amount of attention in the field of crude oil and natural gas processing. On the other hand, minimal studies were directed towards mercury (Hg) capture due to its very small concentrations in oil reservoirs.

Mercury in crude oil or natural gas exists in different species: elemental mercury ($Hg^o$) being the most dominant form, mercuric halides (mostly $HgCl_2$), organic mercury compounds (RHgR and RHgCl) and mercury-sulfur complexes, which are all classified as toxic (Wilhelm and Bloom, Fuel Processing Technology 63 (1), 2000). Beyond the general health and safety risk related to mercury, mercury is also a major problem in oil and gas processing units as it deposits in the cryogenic units and forms amalgams with different metals (such as aluminum). Such deposition can lead to equipment degradation, toxic waste generation, and catalyst poisoning (Wilhelm and Bloom, Fuel Processing Technology 63 (1), 2000). Additionally, mercury emissions are a major environmental concern as they are classified as hazardous air pollutants (HAP) according to the recommendations of the Clean Air Act (CAA) of 1990 (Portney, J. of Econ. Persp. 4(4), 1990).

Several technologies are commercially available for mercury capture from liquid/gas hydrocarbon streams based on either amalgamation (Markovs et al. 1989), physical adsorption (Li et al. 2012), chemical adsorption and/or chemical reaction (Granite, Pennline, and Hargis, Ind. Eng. Chem. Res. 39 (4), 2000). The most mature technologies are based on adsorption mechanisms of mercury on activated carbon and on sulfur/transition metal sulfides impregnated on a solid support, such as activated carbon, alumina, zeolite or silica (e.g. Eckersley, Hydrocarbon processing, 2010; Granite et al., Eng. Chem. Res. 39, 2000; Hiroshi Nishino, Toshio Aibe 1985; Row, Hood, and Matthey 2013). Due to the sensitivity of sulfur to moisture in organic systems, the latter is less suitable for application in liquid streams (Eckersley 2010). Other technologies make use of regenerative molecular sieves impregnated with silver, however, this is an expensive option compared to activated carbon beds. Further, solid-supported ionic liquids (SSILs) has also been described in the art for mercury removal technology from natural gas (Abai et al. 2015). WO 2012/046057 describes a process for the removal of mercury from hydrocarbons by use of ionic liquids (ILs). One of the main disadvantages of ILs, however, is the complexity and cost of synthesis, waste generation, and most of them are derived from fossil fuels. Furthermore, economical regeneration approaches for ILs have not yet been reported.

Owing to the adverse environmental effects of mercury, as well as the operational issues in the oil and gas processing industry, there is still a need in the art to develop an efficient mercury removal system, which is environmentally friendly and inexpensive.

3. BRIEF DESCRIPTION OF THE INVENTION

In this invention, a new technology using deep eutectic solvents (DESs) for mercury extraction from hydrocarbon is suggested to solve the shortcomings of the state of the art.

According to a first aspect of the present invention, a method for the extraction of mercury from a mercury-containing hydrocarbon feed is provided, wherein the method comprises the steps:

- providing a hydrocarbon feed, wherein the hydrocarbon feed comprises a mercury source at an initial concentration $C_{Hg,i}$;
- providing a hydrophilic deep eutectic solvent;
- contacting the hydrophilic deep eutectic solvent with the hydrocarbon feed to form an extraction mixture;
- separating a hydrocarbon product from the extraction mixture, wherein the hydrocarbon product comprises the mercury source at a final concentration $C_{Hg,f}$, wherein $C_{Hg,f}$ is smaller than $C_{Hg,i}$.

The inventors have found that deep eutectic solvents can be applied to efficiently extract mercury from hydrocarbon feeds. This extraction is performed in a highly selective manner, i.e. the deep eutectic solvent extracts mainly the mercury source. The deep eutectic solvent can be easily prepared by simply mixing the constituents of the deep eutectic solvent with no further purification is needed and without waste generation from environmentally friendly and inexpensive sources. Moreover, the deep eutectic solvent is stable over a broad temperature range, non-volatile and non-flammable. A low miscibility or immiscibility with the hydrocarbon feed can be tuned by choosing adequate chemical groups comprised in the solvent. By contacting the hydrocarbon feed and the deep eutectic solvent, mercury sources, such as elemental mercury or mercury halide diffuse into the deep eutectic solvent, where they exhibit a higher solubility and are thereby extracted from the hydrocarbon feed. The hydrocarbon product can be easily separated from the hydrophilic deep eutectic solvent due to the low miscibility of the product and solvent, after a sufficient mercury extraction has been achieved. Further, it could be possible to regenerate the deep eutectic solvent after performing the extraction by means of anti-solvent.

The mercury source may be elemental mercury, an ionic mercury compound and/or an organic mercury compound. The ionic mercury compound may be in particular a mercury halide or a mercury sulfur complex. These mercury sources are often found in natural hydrocarbon feeds, such as crude oil or natural gas.

The deep eutectic solvent may be a type I, a type II, a type III, or a type IV deep eutectic solvent, wherein a type I deep eutectic solvent is described by the formula $Cat^+ X^- z\ MCl_x$, with $Cat^+$ being an ammonium, phosphonium or sulfonium cation, $X^-$ being a Lewis base, preferably a halide anion, M being Zn, Sn, Fe, Al, Ga, or In, z is the number of $MCl_x$ molecules that interact with $X^-$, and x is between 1 and 3;

wherein a type II deep eutectic solvent is described by the formula $Cat^+ X^- z\ MC_x yH_2O$, with $Cat^+$ being an ammonium, phosphonium or sulfonium cation, $X^-$ being a Lewis base, preferably a halide anion, M being Cr, Co, Cu, Ni or Fe, z is the number of $MCl_x$ molecules that interact with $X^-$, x is between 1 and 4, and y is the number of coordinated water molecules;

wherein a type III deep eutectic solvent is described by the formula $Cat^+ X^- zZ$, with $Cat^+$ being an ammonium, phosphonium or sulfonium cation, $X^-$ being a Lewis base, preferably a halide anion, Z being a hydrogen-bond donor selected from the group consisting of amines, amides, carboxylic acids or alcohols, and z is the number of hydrogen bond donor molecules that interact with X−;

wherein a type IV deep eutectic solvent is described by the formula $MCl_x$ Z, with M being Al or Zn, and Z being an amide or an alcohol.

One of the preferred deep eutectic solvents according to the invention are deep eutectic solvents of type III.

The hydrophilic deep eutectic solvent may comprise at least one hydrogen bond acceptor and at least one hydrogen bond donor. Such solvents can be tuned to provide high solubility for the mercury sources to be extracted from the hydrocarbon feed.

The at least one hydrogen bond donor may be an amine, an amide, a carboxylic acid or an alcohol. In particular, the at least one hydrogen bond donor may be an amide selected from the group consisting of urea, acetamide, thiourea, and amino acids. The amino acids may be naturally occurring amino acids, or amino acid derivatives. These classes of hydrogen bond donors have shown optimal results for mercury extraction. Moreover, they are usually non-hazardous, and biodegradable compounds.

The at least one hydrogen bond donor may be a carboxylic acid selected from the group consisting of malic acid, maleic acid, citric acid, lactic acid, pyruvic acid, fumaric acid, glycolic acid, succinic acid, acetic acid, aconitic acid, tartaric acid, malonic acid, ascorbic acid, glucuronic acid, oxalic acid, neuraminic acid, sialic acids, levulinic acid, trichloroacetic acid, phenylacetic acid. In particular, naturally occurring organic acids may be used, such as malic acid, maleic acid, citric acid, lactic acid, pyruvic acid, fumaric acid, glycolic acid, succinic acid, acetic acid, aconitic acid, tartaric acid, malonic acid, ascorbic acid, glucuronic acid, oxalic acid, neuraminic acid, sialic acids, levulinic acid. These hydrogen bond donors are inexpensive due to simple synthesis and furthermore non-hazardous.

The at least one hydrogen bond donor may be an alcohol selected from the group consisting of sucrose, glucose, fructose, lactose, maltose, arabinose, ribose, ribulose, galactose, rhamnose, raffinose, xylose, sucrose, mannose, trehalose, mannitol, sorbitol, inositol, ribitol, galactitol, erythritol, xyletol adonitol, cresol, phenol, ethylene glycol. These hydrogen bond donors can be extracted from biological systems or can be easily synthesized and are non-hazardous.

The at least one hydrogen bond acceptor may be a salt of formula $Cat^+ X^-$, wherein $Cat^+$ is an ammonium, phosphonium or sulfonium cation, and $X^-$ is a halide anion. The inventors have found that such a deep eutectic solvent comprising non-hazardous, 15 degradable organic hydrogen bond acceptors yields high mercury extraction efficiencies.

$Cat^+$ may be a quaternary ammonium cation, preferably selected from the group consisting of choline and tetrabutylammonium, and $X^-$ may be chloride or bromide.

Alternatively, the at least one hydrogen bond acceptor may be a zwitterionic compound, preferably comprising an amine, a quaternary ammonium or a phosphonium group. The inventors have found that zwitterionic compounds as hydrogen bond acceptors in the deep eutectic solvent work as well as salts.

The zwitterionic compound may be selected from the group consisting of proline, glycine, and N,N,N-trimethylglycine. These amino acids or amino acid derivatives are naturally occurring compounds, degradable and non-toxic.

In particular, the deep eutectic solvent may comprise as hydrogen bond acceptors and hydrogen bond donors choline chloride and urea; and/or choline chloride and ethylene glycol; and/or choline chloride and levulinic acid; and/or betaine and levulinic acid. By use of these solvents in the extraction method, high extraction efficiencies can be achieved. Moreover, all compounds are environmentally friendly and simple to produce or to enrich from biological systems.

Preferably the deep eutectic solvent consists of choline chloride and urea; or choline chloride and ethylene glycol; or choline chloride and levulinic acid; or betaine and levulinic acid.

The at least one hydrogen bond acceptor and the at least one hydrogen bond donor may be comprised in a molar ratio of about 0.5:2 to 2:1, preferably of about 1:2. The molar ratio should be chosen such that the melting temperature of the deep eutectic solvent is compatible with the method, i.e. that the deep eutectic solvent is molten at the operating temperature.

The hydrocarbon feed may be liquid. Alternatively, it is conceivable that the hydrocarbon feed is gaseous, e.g. the hydrocarbon feed may be natural gas.

The deep eutectic solvent and the hydrocarbon feed may be provided in a mass ratio of between 0.1:1 and 10:1, preferably between 0.5:1 and 3:1, more preferably between 1:1 and 2:1. The ratio may be in particular varied depending on the concentration of mercury compounds in the hydrocarbon feed.

The contacting may be conducted at a temperature of at least 10° C., preferably at least 20° C. This ensures that the deep eutectic solvent has a sufficiently low viscosity.

The contacting may be conducted at a temperature of at most 100° C., preferably at most 80° C., more preferably at most 50° C. This ensures that the deep eutectic solvent remains stable during the step of contacting, and is not decomposed.

Preferably, the contacting is conducted at a temperature between 25 and 50° C., more preferably between 30 and 40° C. Such a temperature regime provides for optimal working viscosities and stability of the deep eutectic solvent.

The contacting may be conducted at atmospheric pressure. Thereby, the extraction method can be performed in reactors without specific pressure control units.

The contacting may be conducted for at least 15 minutes, preferably at least 30 minutes, more preferably at least 1 hour, even more preferably at least 2 hours.

The extraction mixture may be in particular agitated during the step of contacting. Such agitation accelerates the overall diffusion process of the mercury compounds into the deep eutectic solvent.

The hydrocarbon feed may be separated from the extraction mixture by means of gravity separation. Gravity separation can be applied due to the low miscibility or immiscibility of the solvent and the hydrocarbon feed.

$C_{Hg,f}$ may be at most 0.5 $C_{Hg,i}$, preferably at most 0.3 $C_{Hg,i}$. The method may have an extraction efficiency E, defined as $(C_{Hg,i}-C_{Hg,f})/C_{Hg,i}$ of at least 0.75, preferably at least 0.8, more preferably at least 0.85.

After separating the hydrocarbon feed the mercury compound and/or the hydrophilic deep eutectic solvent may be recovered from the extraction mixture. It is further proposed to recover the deep eutectic solvents via anti-solvent precipitation to separate the mercury from the deep eutectic solvent.

Thereby, the deep eutectic solvent can be recycled and reused for extracting mercury from hydrocarbon feeds.

According to another aspect of the present invention a deep eutectic solvent is used for 25 the extraction of a mercury source from a hydrocarbon feed, wherein the deep eutectic solvent comprises at least one hydrogen bond acceptor and at least one hydrogen bond donor.

The deep eutectic solvent used for the extraction of a mercury source from a 30 hydrocarbon feed may be a type I, a type II, a type III, or a type IV deep eutectic solvent, wherein a type I deep eutectic solvent is described by the formula $Cat^+ X^- z MCl_x$, with $Cat^+$ being an ammonium, phosphonium or sulfonium cation, $X^-$ being a Lewis base, preferably a halide anion, M being Zn, Sn, Fe, Al, Ga, or In, z is the number of $MCl_x$ molecules that interact with $X^-$, and x is between 1 and 3;

wherein a type II deep eutectic solvent is described by the formula $Cat^+ X^- z MC_x y H_2O$, with $Cat^+$ being an ammonium, phosphonium or sulfonium cation, $X^-$ being a Lewis base, preferably a halide anion, M being Cr, Co, CU, Ni or Fe, z is the number of $MCl_x$ molecules that interact with $X^-$, x is between 1 and 3, and y is the number of coordinated water molecules;

wherein a type III deep eutectic solvent is described by the formula $Cat^+ X^- zZ$, with $Cat^+$ being an ammonium, phosphonium or sulfonium cation, $X^-$ being a Lewis base, preferably a halide anion, Z being a hydrogen-bond donor selected from the group consisting of amines, amides, carboxylic acids or alcohols, and z is the number of hydrogen bond donor molecules that interact with X−;

wherein a type IV deep eutectic solvent is described by the formula $MCl_x$ Z, with M being Al or Zn, Z being an amide or an alcohol.

One of the preferred deep eutectic solvents used for the extraction of a mercury source from a hydrocarbon feed are deep eutectic solvents of type III. The hydrophilic deep eutectic solvent may comprise at least one hydrogen bond acceptor and at least one hydrogen bond donor.

The at least one hydrogen bond donor may be an amine, an amide, a carboxylic acid or an alcohol. In particular, the at least one hydrogen bond donor may be an amide selected from the group consisting of urea, acetamide, thiourea, and amino acids. The amino acids may be naturally occurring amino acids, or amino acid derivatives.

The at least one hydrogen bond donor may be a carboxylic acid selected from the group consisting of malic acid, maleic acid, citric acid, lactic acid, pyruvic acid, fumaric acid, glycolic acid, succinic acid, acetic acid, aconitic acid, tartaric acid, malonic acid, ascorbic acid, glucuronic acid, oxalic acid, neuraminic acid, sialic acids, levulinic acid, trichloroacetic acid, phenylacetic acid.

The at least one hydrogen bond donor may be an alcohol selected from the group consisting of sucrose, glucose, fructose, lactose, maltose, arabinose, ribose, ribulose, galactose, rhamnose, raffinose, xylose, sucrose, mannose, trehalose, mannitol, sorbitol, inositol, ribitol, galactitol, erythritol, xyletol adonitol, cresol, phenol, ethylene glycol.

The at least one hydrogen bond acceptor may be a salt of formula $Cat^+ X^-$, wherein $Cat^+$ is an ammonium, phosphonium or sulfonium cation, and $X^-$ is a halide anion. $Cat^+$ may be a quaternary ammonium cation, preferably selected from the group consisting of choline and tetrabutylammonium, and $X^-$ may be chloride or bromide.

Alternatively, the at least one hydrogen bond acceptor may be a zwitterionic compound, preferably comprising an amine, a quaternary ammonium or a phosphonium group. The zwitterionic compound may be selected from the group consisting of proline, glycine, and N,N,N-trimethylglycine.

In particular, the deep eutectic solvent used for the extraction of a mercury source from a hydrocarbon feed may comprise as hydrogen bond acceptors and hydrogen bond donors choline chloride and urea; and/or choline chloride and ethylene glycol; and/or choline chloride and levulinic acid; and/or betaine and levulinic acid. By use of these solvents in the extraction method, high extraction efficiencies can be achieved. Moreover, all compounds are environmentally friendly and simple to produce or to enrich from biological systems. Preferably the deep eutectic solvent consists of choline chloride and urea; and/or choline chloride and ethylene glycol; and/or choline chloride and levulinic acid; and/or betaine and levulinic acid.

The at least one hydrogen bond acceptor and the at least one hydrogen bond donor may be comprised in a molar ratio of about 0.5:2 to 2:1, preferably of about 1:2.

The term "deep eutectic solvent" refers to a liquid having a melting point which is lower than the melting point of the two or more components that form the deep eutectic solvent. The components of the deep eutectic solvent interact which each other through hydrogen bonding. The deep eutectic solvent may be formed from one hydrogen bond acceptor species and one hydrogen bond donor species (i.e. Lewis or Brønsted bases and acids), or the deep eutectic solvent may be formed from each more than one species.

4. BRIEF DESCRIPTION OF THE DRAWING

FIG. 1 illustrates a routine for the extraction of mercury according to the invention.

5. DETAILED DESCRIPTION OF THE INVENTION

Preferred embodiments of the invention will be described in the following detailed description. It is emphasized, however, that the present invention is not limited to these embodiments.

In 2003, Abbott et al. (Abbott et al. 2003) introduced a novel class of solvents, the so-called deep eutectic solvents (DESs). DESs comprise at least one predominantly hydrogen bond donor (HBD) compound and at least one predominantly hydrogen bond acceptor (HBA) compound that form a mixture exhibiting a significantly lower freezing point than both of the pure compounds. DESs have a low vapor pressure, a wide liquid range, and low flammability, and, importantly, are simple to prepare. In particular, low-cost HBD and HBA ingredients that are mostly biodegradable can be used.

The present invention describes for the first time the use of DESs as extracting agents for removal mercury from Hg-containing hydrocarbons, such as crude oil or natural gas. The inventors found that DESs are highly efficient for the extraction of mercury, relating to their strong affinity for solvating various mercury species, their low mutual solubility with hydrocarbons, and their thermal stability. Compared to ionic liquids, which are formed from discrete anions and cations, deep eutectic solvents are generally less expensive, in particular because of their easier synthesis. No purification step is required during/after synthesis of the deep eutectic solvent, making a large-scale use of DESs feasible. Moreover, DESs are mostly biodegradable and non-toxic. Also, DESs might be recovered, e.g. by anti-solvent precipitation.

As described in FIG. 1, the method according to the invention comprises the steps of providing a deep eutectic solvent and a mercury containing hydrocarbon feed. The method can be integrated into refining processes of natural gas or crude oil. The deep eutectic solvent and the hydrocarbon feed are contacted to form an extraction mixture. For example, in case the hydrocarbon feed is liquid, the feed and the solvent can be combined in a container to form the extraction mixture. Further, the extraction mixture can be constantly agitated during extraction to improve the overall extraction efficiency. The hydrocarbon product, which contains a lower concentration of mercury source than the feed, is then separated from the extraction mixture, e.g. via gravity separation or centrifugation. After separation, the deep eutectic solvent is enriched with the mercury source. It is also suggested to separate the mercury from the deep eutectic solvent by means of anti-solvent precipitation.

The deep eutectic solvent can be regenerated to be used again in the method according to the invention. Alternatively, the deep eutectic solvent may be used for other applications, such as battery production or other electrochemical products or processes.

Example 1: Preparation of Deep Eutectic Solvents

Several DESs for extracting mercury were tested:

"DES-1": choline chloride:urea

"DES-2": choline chloride:ethylene glycol

"DES-3": choline chloride:levulinic acid

"DES-4": betaine:levulinic acid

In all cases the molar ratio was 1:2. DES-4 was chosen to test the influence of replacing a salt-based HBA with a zwitterionic HBA, i.e. with betaine.

The chemical compounds, along with their sources and purities are reported in Table 1. The choline chloride was dried under vacuum prior to use. The other chemicals were used as obtained.

TABLE 1

Chemicals for the preparation of DESs.

| Chemical | Purity (wt %) | Source |
|---|---|---|
| Choline chloride | ≥98 | Sigma-Aldrich |
| Urea | ≥98 | Sigma-Aldrich |
| Ethylene glycol | ≥99.8 | Sigma-Aldrich |
| Levulinic acid | ≥98 | Sigma-Aldrich |
| Betaine | ≥98 | Sigma-Aldrich |
| Dodecane | ≥99 | Merck |
| Mercury | Extra pure | Merck |

The molecular structures of the constituents for the four DESs are provided in Table 2. The DESs (DES1 to DES4) were prepared in 50 g batches using a 1:2 molar ratio for HBA:HBD. The constituents were accurately weighed using a Sartorius ED 224S analytical balance with a precision of ±0.1 mg, then added together in closed 100 mL glass bottles and mixed thoroughly using a Vortex mixer (VWR). The mixtures were stirred at 323.15 K in a temperature controlled oil bath with a temperature controller (IKA ETS-D5, uncertainty=±0.1 K), until a homogeneous clear liquid was formed.

TABLE 2

Molecular structure of the constituents for the DESs investigated.

| HBA | HBD |
|---|---|
| 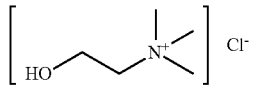 choline chloride | 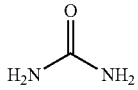 urea |
| 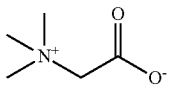 betaine | 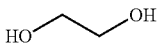 ethylene glycol |

TABLE 2-continued

Molecular structure of the constituents for the DESs investigated.

| HBA | HBD |
|---|---|
| | 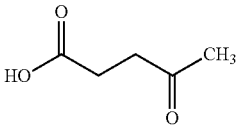 levulinic acid |

Example 2: Mercury Extraction from Hydrocarbon Feed

N-dodecane was used as a model system for aliphatic hydrocarbons in petroleum. 25 mL of n-Dodecane (>99% purity) was saturated with elemental mercury (extra pure) at ambient conditions to a concentration of approximately 4000 μg $kg^{-1}$. The saturated n-dodecane solution was added to the DESs using a 1:1 or a 2:1 solvent-to-feed mass ratio. The mixtures were initially mixed for a short time using a Vortex mixer followed by shaking the solutions for 2 h using an incubating shaker (IKA KS 4000 i) at temperatures of 303.15 K or 333.15 K. The mixtures were left to settle for 30 min until liquid-liquid coexistence was visually observed with the n-dodecane and DES being the upper and lower phases, respectively. A sample from the n-dodecane phase was taken using a syringe without disturbing the equilibrium interface. The n-dodecane sample was then analyzed for its mercury content using a Milestone Direct Mercury Analyzer DMA-80 pyrolysis/AA analyzer. A sample of the n-dodecane phase (20-30 mg) was introduced in the DMA-80, in which the sample is initially dried at T=573 K and then thermally decomposed at T=1123 K in an oxygen flow (200 mL $min^{-1}$) and a gas pressure of 4 bar. The combustion products were carried off and further decomposed in a hot catalyst bed at T=873 K. The mercury vapors are trapped on a gold amalgamator and subsequently desorbed at T=1173 K. Finally, the mercury content was determined using atomic absorption spectrophotometry at 254 nm.

The extraction performance for the system [n-dodecane+$Hg_o$+DES] was evaluated for solvent: feed ratios of 1:1 and 2:1 (mass ratio), wherein the solvent and feed were incubated at temperatures T=303.15 and T=333.15 K and atmospheric pressure, as described above. No color change was noticed when the DESs were mixed with the n-dodecane solution and the mercury was transferred from the non-polar alkane phase to the polar DES phase. The initial and final mercury concentrations in the n-dodecane solution, $C_{Hg,i}$ and $C_{Hg,f}$, respectively, were measured in triplicate for each sample, and each extraction experiment was done in duplicate. The results are reported in Table 3 The extraction efficiencies, E, were calculated as follows:

$$E=(C_{Hg,i}-C_{Hg,f})/C_{Hg,i}$$

TABLE 3

Concentrations obtained for two extraction experiments (labeled by superscripts A and B), and derived efficiencies. The standard deviations are estimated from replicate measurements and error propagation.

| DES # | T [K] | Mass ratio (solvent:feed) | $C_{Hg,i}^{A}$ [μg kg$^{-1}$] | $C_{Hg,f}^{A}$ [μg kg$^{-1}$] | $C_{Hg,i}^{B}$ [μg kg$^{-1}$] | $C_{Hg,f}^{B}$ [μg kg$^{-1}$] | E [%] |
|---|---|---|---|---|---|---|---|
| DES-1 | 303.15 | 1:1 | 3670 ± 90 | 260 ± 10 | 3670 ± 90 | 280 ± 10 | 93 ± 3 |
| DES-1 | 303.15 | 2:1 | 3420 ± 30 | 200 ± 10 | 4120 ± 140 | 600 ± 10 | 90 ± 7 |
| DES-1 | 333.15 | 1:1 | 3950 ± 80 | 830 ± 20 | 3950 ± 80 | 520 ± 20 | 83 ± 6 |
| DES-1 | 333.15 | 2:1 | 3950 ± 80 | 460 ± 20 | 3950 ± 80 | 790 ± 10 | 84 ± 7 |
| DES-2 | 303.15 | 1:1 | 3670 ± 90 | 570 ± 20 | 3670 ± 90 | 590 ± 10 | 84 ± 3 |
| DES-2 | 303.15 | 2:1 | 3420 ± 30 | 240 ± 10 | 4120 ± 140 | 480 ± 10 | 91 ± 5 |
| DES-2 | 333.15 | 1:1 | 3990 ± 150 | 370 ± 10 | 3990 ± 150 | 330 ± 10 | 91 ± 4 |
| DES-2 | 333.15 | 2:1 | 3990 ± 150 | 210 ± 10 | 3990 ± 150 | 170 ± 10 | 95 ± 5 |
| DES-3 | 303.15 | 1:1 | 3680 ± 90 | 380 ± 10 | 3670 ± 90 | 460 ± 20 | 88 ± 4 |
| DES-3 | 303.15 | 2:1 | 3420 ± 30 | 270 ± 10 | 4120 ± 140 | 270 ± 10 | 93 ± 4 |
| DES-3 | 333.15 | 1:1 | 4970 ± 40 | 140 ± 10 | 4970 ± 40 | 110 ± 10 | 97 ± 6 |
| DES-3 | 333.15 | 2:1 | 4970 ± 40 | 30 ± 2 | 4970 ± 40 | 24 ± 2 | 99 ± 6 |
| DES-4 | 303.15 | 1:1 | 4160 ± 60 | 550 ± 10 | 4160 ± 60 | 480 ± 20 | 88 ± 3 |
| DES-4 | 303.15 | 2:1 | 4160 ± 60 | 460 ± 20 | 4120 ± 140 | 220 ± 10 | 92 ± 6 |
| DES-4 | 333.15 | 1:1 | 3710 ± 110 | 400 ± 10 | 3710 ± 110 | 450 ± 10 | 88 ± 3 |
| DES-4 | 333.15 | 2:1 | 3710 ± 110 | 490 ± 20 | 3710 ± 110 | 490 ± 20 | 87 ± 4 |

All tested DESs exhibited extraction efficiencies above 80%. The zwitterion containing DES-4 performed as well as the other DESs comprising choline chloride as HBA.

The invention claimed is:

1. A method for the extraction of mercury from a mercury-containing hydrocarbon feed, comprising the steps:

providing a hydrocarbon feed, wherein the hydrocarbon feed comprises a mercury source at an initial concentration $C_{Hg,i}$;

providing a hydrophilic deep eutectic solvent;

contacting the hydrophilic deep eutectic solvent with the hydrocarbon feed to form an extraction mixture; and separating a hydrocarbon product from the extraction mixture, wherein the hydrocarbon product comprises the mercury source at a final concentration $C_{Hg,f}$, wherein $C_{Hg,f}$, is smaller than $C_{Hg,i}$;

wherein the hydrophilic deep eutectic solvent comprises at least one hydrogen bond acceptor and at least one hydrogen bond donor, wherein the at least one hydrogen bond donor is an amine, an amide, a carboxylic acid or an alcohol, wherein the at least one hydrogen bond acceptor is a zwitterionic compound selected from the group consisting of proline, glycine, and N,N,N-trimethylglycine, and wherein the at least one hydrogen bond acceptor and the at least one hydrogen bond donor are included in the hydrophilic deep eutectic solvent in a molar ratio of about 1:2.

2. The method of claim 1, wherein the mercury source is elemental mercury, an ionic mercury compound, and/or an organic mercury compound.

3. The method of claim 1, wherein the at least one hydrogen bond donor is selected from the group consisting of urea, acetamide, thiourea, amino acids, malic acid, maleic acid, citric acid, lactic acid, pyruvic acid, fumaric acid, glycolic acid, succinic acid, acetic acid, aconitic acid, tartaric acid, malonic acid, ascorbic acid, glucuronic acid, oxalic acid, neuraminic acid, sialic acids, levulinic acid, trichloroacetic acid, phenylacetic acid, sucrose, glucose, fructose, lactose, maltose, arabinose, ribose, ribulose, galactose, rhamnose, raffinose, xylose, mannose, trehalose, mannitol, sorbitol, inositol, ribitol, galactitol, erythritol, xyletol, adonitol, cresol, phenol, ethylene glycol.

4. The method of claim 1, wherein the zwitterionic compound includes an amine group, a quaternary ammonium group or a phosphonium group.

5. The method of claim 1, wherein the hydrophilic deep eutectic solvent comprises choline chloride and urea; and/or choline chloride and ethylene glycol; and/or choline chloride and levulinic acid; and/or betaine and levulinic acid.

6. The method of claim 1, wherein the hydrocarbon feed is a liquid.

7. The method of claim 1, wherein the hydrophilic deep eutectic solvent and the hydrocarbon feed are provided in a mass ratio of between 1:1 and 2:1.

8. The method of claim 1, wherein the contacting is conducted at a temperature of at least 20° C.

9. The method of claim 1, wherein the contacting is conducted at a temperature of at most 50° C.

10. The method of claim 1, wherein the contacting is conducted at atmospheric pressure.

11. The method of claim 1, wherein the contacting is conducted for at least 1 hour.

12. The method of claim 1, wherein the hydrocarbon product is separated from the extraction mixture by means of gravity separation.

13. The method of claim 1, wherein $C_{Hg,f}$, is at most 0.3 $C_{Hg,i}$.

14. The method of claim 1, wherein the method has an extraction efficiency E, defined as $(C_{Hg,i}-C_{Hg,f})/C_{Hg,i}$ of at least 0.85.

15. The method of claim 1, wherein after separating the hydrocarbon product, the hydrophilic deep eutectic solvent is recovered from the remaining extraction mixture.

* * * * *